US007224332B2

(12) United States Patent
Cok

(10) Patent No.: US 7,224,332 B2
(45) **Date of Patent: *May 29, 2007**

(54) METHOD OF AGING COMPENSATION IN AN OLED DISPLAY

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 369 days.

This patent is subject to a terminal disclaimer.

(21) Appl. No.: 10/721,124

(22) Filed: Nov. 25, 2003

(65) Prior Publication Data

US 2005/0110728 A1 May 26, 2005

(51) Int. Cl.
*G09G 3/30* (2006.01)
*G09G 5/00* (2006.01)

(52) U.S. Cl. ..... 345/76; 345/211; 345/77; 345/78

(58) Field of Classification Search ..... 345/76–83, 345/204, 211, 690
See application file for complete search history.

(56) References Cited

U.S. PATENT DOCUMENTS 4,443,741 A * 4/1984 Tanaka et al. ..... 315/307
6,320,325 B1 * 11/2001 Cok et al. ..... 315/169.3
6,414,661 B1 7/2002 Shen et al.
6,456,016 B1 9/2002 Sundahl et al.
6,501,230 B1 12/2002 Feldman
6,504,565 B1 1/2003 Narita et al.
6,518,962 B2 * 2/2003 Kimura et al. ..... 345/211
6,710,548 B2 * 3/2004 Kimura ..... 315/169.3
7,042,427 B2 * 5/2006 Inukai ..... 345/77
2003/0048243 A1 3/2003 Kwasnick
2003/0071804 A1 4/2003 Yamazaki et al.

FOREIGN PATENT DOCUMENTS

EP 1 225 557 7/2002
JP 2002/278514 9/2002

* cited by examiner

*Primary Examiner*—Richard Hjerpe
*Assistant Examiner*—Duc Dinh
(74) *Attorney, Agent, or Firm*—Andrew J. Anderson

(57) ABSTRACT

A method for controlling aging compensation in an OLED display having one or more light emitting elements includes the steps of periodically measuring the change in display output to calculate a correction signal; restricting the change in the correction signal at each period; and applying the correction signal to the OLED display to effect a correction in the display output.

24 Claims, 2 Drawing Sheets

METHOD OF AGING COMPENSATION IN AN OLED DISPLAY

FIELD OF THE INVENTION

The present invention relates to OLED flat-panel displays and more particularly to methods for providing aging compensation to such displays.

BACKGROUND OF THE INVENTION

Solid-state organic light emitting diode (OLED) image display devices are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the device age and become less efficient at emitting light. This reduces the lifetime of the display. The differing organic materials may age at different rates, causing differential color aging and a display whose white point varies as the display is used.

Referring to FIG. 2, a graph illustrating the typical light output of a prior-art OLED display device as current is passed through the OLEDs is shown. The three curves represent typical change in performance of red, green and blue light emitters over time. As can be seen by the curves, the decay in luminance between the differently colored light emitters is different. Hence, in conventional use, with no aging correction, as current is applied to each of the differently colored OLEDs, the display will become less bright and the color, in particular the white point, of the display will shift.

A variety of methods for measuring or predicting the aging of the OLED materials in displays are known in the art. For example, U.S. Pat. No. 6,456,016 issued Sep. 24, 2002 to Sundahl et al., titled "Compensating Organic Light Emitting Displays" relies on a controlled reduction of current provided at an early stage of device use followed by a second stage in which the display output is gradually decreased. U.S. Pat. No. 6,414,661 entitled "Method And Apparatus For Calibrating Display Devices And Automatically Compensating For Loss In Their Efficiency Over Time" issued Jul. 2, 2002 to Shen et al, describes a method and associated system that compensates for long-term variations in the light-emitting efficiency of individual organic light emitting diodes (OLEDs) in an OLED display device, by calculating and predicting the decay in light output efficiency of each pixel based on the accumulated drive current applied to the pixel and derives a correction coefficient that is applied to the next drive current for each pixel. U.S. Published Patent Application No. 2002/0167474 "Method Of Providing Pulse Amplitude Modulation For OLED Display Drivers" published Nov. 14, 2002 by Everitt describes a pulse width modulation driver for an organic light emitting diode display. One embodiment of a video display comprises a voltage driver for providing a selected voltage to drive an organic light emitting diode in a video display. The voltage driver may receive voltage information from a correction table that accounts for aging, column resistance, row resistance, and other diode characteristics.

U.S. Pat. No. 6,504,565 titled "Light-Emitting Device, Exposure Device, And Image Forming Apparatus", issued Jan. 7, 2003 to Narita et al describes a light-emitting device which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant.

JP 2002/278514 A titled "Electro-Optical Device" and published Sep. 27, 2002 by Koji describes a method in which a prescribed voltage is applied to organic EL elements by a current-measuring circuit and the current flows are measured. A temperature measurement circuit estimates the temperature of the organic EL elements.

All of the methods described above change the output of the OLED display to compensate for changes in the OLED light emitting elements. However, it is preferable that any changes made to the display be imperceptible to a user. Since displays are typically viewed in a single-stimulus environment, slow changes over time are acceptable, but large, noticeable changes are objectionable. Since continuous, real-time corrections are usually not practical because they interfere with the operation of the OLED display, most changes in OLED display compensation are done periodically. Hence, if an OLED display output changes significantly during a single period, a noticeably objectionable correction to the appearance of the display may result.

It is also true that in any real system, measurement anomalies may occur due to environmental or system perturbations or noise that do not reflect the actual situation. Corrections in response to such anomalies are undesirable and may result in damage to the system or may degrade display performance. Manufacturing processes used to make OLED displays also exhibit variability that affects the performance of the display and this manufacturing variability needs to be accommodated in any practical aging correction method.

Referring to FIG. 3, prior art systems providing aging compensation to OLED displays typically include a display 30 for displaying images. The display 30 is controlled by a controller 32 that receives image or data signals 34 from an external device. The image or data signals 34 are converted into the appropriate control signals 36 using conversion circuitry 38 within the controller 32 and applied to the display 30. A performance attribute of the display, for example the current or voltage within the display 30, is measured and a feedback signal 40 is supplied through a measurement circuit 42 and provided to the controller 30. The controller then uses the measured feedback signal 40 to change the control signals 36 to compensate for any aging detected in the display 30.

The measurement circuit 42 may be incorporated into the display 30, into the controller 32, or may be a separate circuit 42 (as shown). Likewise, the feedback signal may be detected within the display (as shown) or measured externally by the controller 32 or some other circuit. For example, the luminance of the display 32 may be measured by an external photo-sensor or camera or be detected by photo-sensors on the display itself.

In some prior art embodiments, the feedback signal 40 is not produced by the display 30, but is produced by analyzing the control signals 36 input to the display 30. For example, a useful feedback signal known in the prior art is the accumulation of current provided to the display 30. Since aging depends on total current passed through a display, a measurement of the accumulated current can be used to predict the aging of the display 30. Alternatively, the luminance signal sent to the display 30 as part of the control signals 36 may be accumulated over time to provide the feedback signal 40. A knowledge of the intended luminance of the display 30 can be used to predict aging and then the effects of aging can be compensated. Although a continuous correction of aging is possible in some of these configurations, corrections are often applied periodically so as not to interfere with the use of the device.

It is also the case that some environmental factors, for example temperature of operation, length of operation, and time since previous operation all contribute to the efficiency of the display. It is difficult to accommodate all environmental factors in a correction scheme. Therefore, it is important to provide corrections that are robust in the face of unanticipated environmental variables. The methods shown in the prior art do not address these environmental variables.

There is a need therefore for an improved aging compensation method for organic light emitting diode displays.

SUMMARY OF THE INVENTION

The need is met by providing a method for controlling aging compensation in an OLED display having one or more light emitting elements that includes the steps of periodically measuring the change in display output to calculate a correction signal; restricting the change in the correction signal at each period; and applying the correction signal to the OLED display to effect a correction in the display output.

Advantages

An advantage of this invention is that it compensates for the aging of the organic materials in a display in the presence of varying environmental factor and system noise, and provides a correction that does not become objectionably visible to a user of the display.

DETAILED DESCRIPTION OF THE INVENTION

Figure 1:
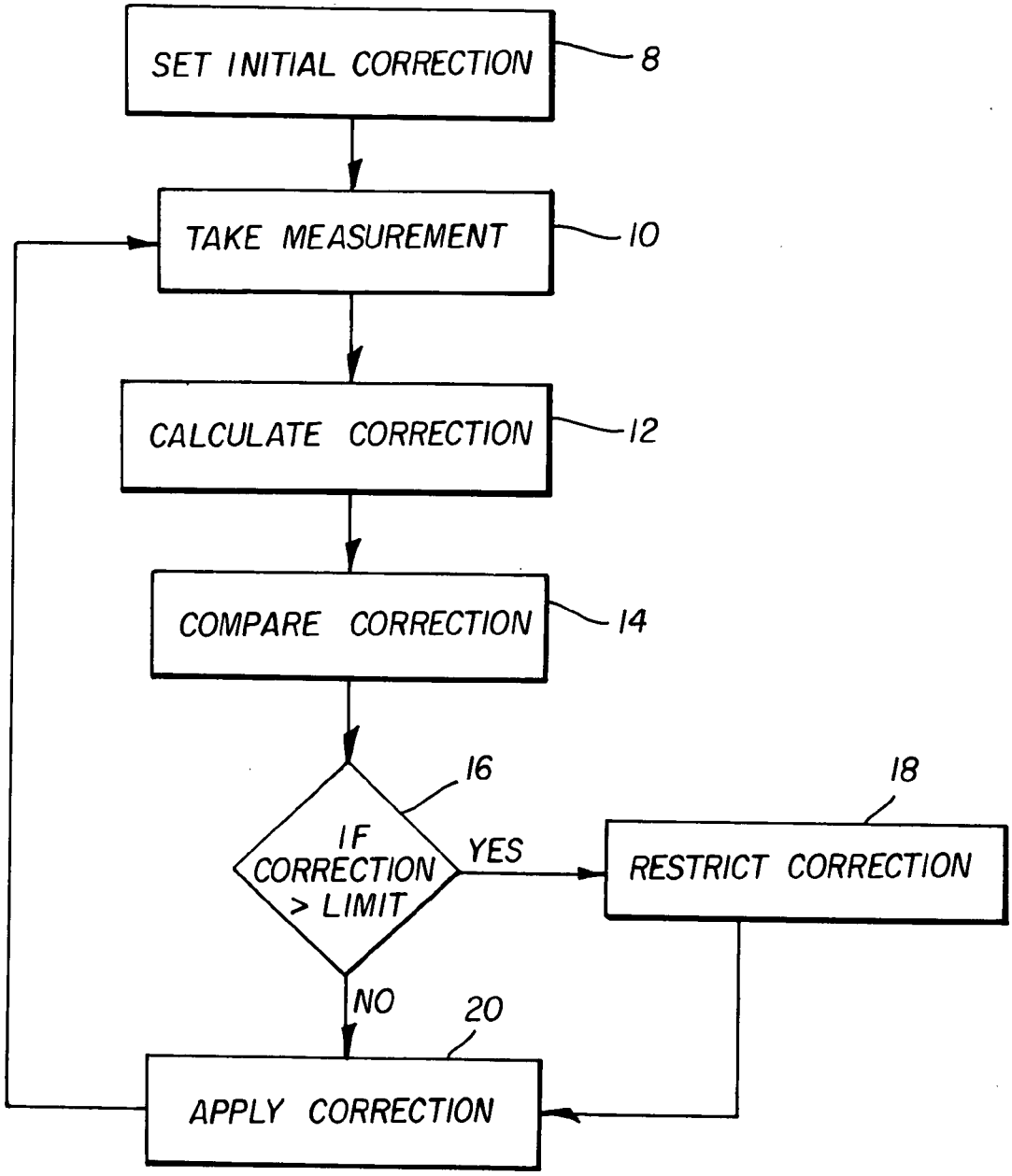
FIG. 1 is a flow chart showing an embodiment of the method of the present invention.
Figure 2:
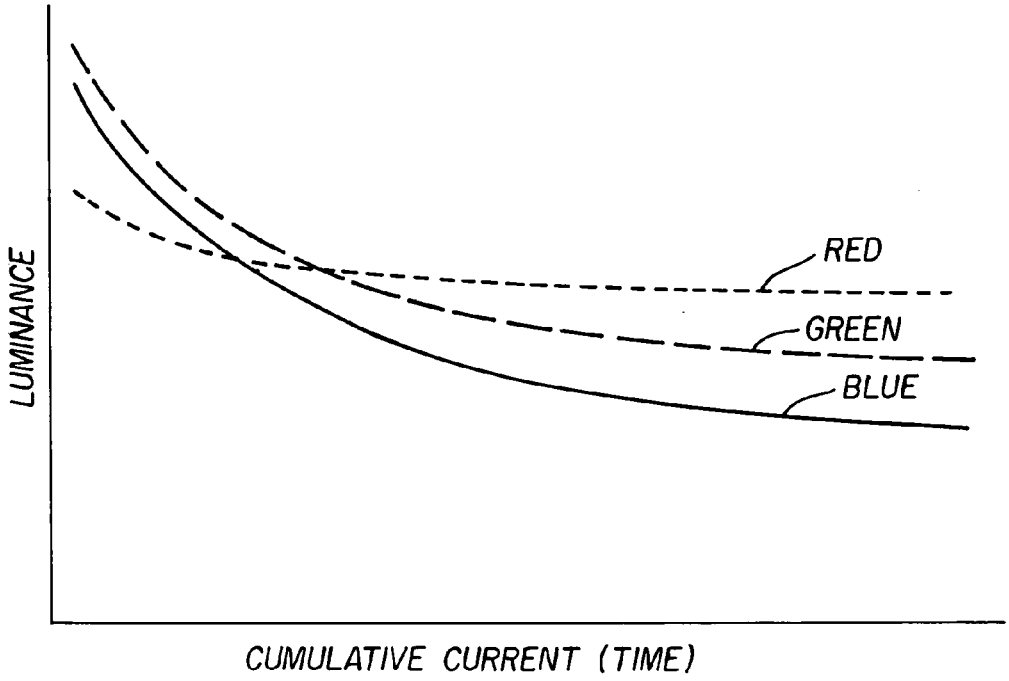
FIG. 2 (Prior Art)
FIG. 2 is a graph showing typical aging characteristics for differently colored OLEDs in a prior art display.
Figure 3:
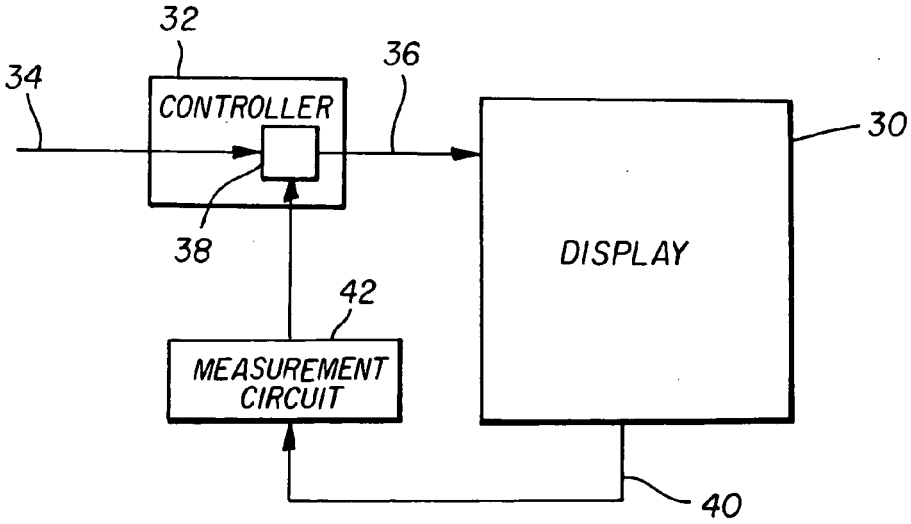
FIG. 3 (Prior Art)
FIG. 3 is a schematic diagram of a display device with feedback and control circuits according to the present invention.

Referring to FIG. 1, in one embodiment of the present invention, a correction signal value is initialized 8, to a value representing no change in the control signals used to drive the display. When the display is in use, a change in display output is measured 10. From this measurement, a correction signal value is calculated 12. Rather than simply applying the correction signal to the control signals, as is done in the prior art, any change in the correction signal value is compared 14 to a correction limit. In decision step 16, if the change in the correction signal value is within the correction limit, a correction is applied 20 to the control signals 36. If the change in the correction signal value exceeds the correction limit, the correction signal value is restricted 18 by reducing the magnitude of the change in the correction signal value, and then applying 20 the restricted correction signal to the control signals 36. In this case, the correction will not have corrected for all of the aging dictated by the feedback signal 40, but the amount of correction will be restricted to a correction that is not visibly objectionable to a viewer, or result in an undesirable correction due to noise.

Once the correction is applied, the cycle is complete. After some period the cycle repeats. The period can be defined in a variety of ways, for example by time of use or by events such as power-up or power-down. Over time the correction applied will accommodate the display aging but in circumstances where the display ages very rapidly, the accommodation may take several cycles to fully accommodate the display aging. Since a long period of use may occur between the correction cycles described in FIG. 1, perceptible aging may occur in a display before a new correction value is applied. However, because the aging is gradual and viewing of the display generally takes place in a single stimulus context, it is not likely that the aging of the display will be noticed by a user. However, if a large correction is applied all at once, the correction may be perceptible to a user. Moreover, a correction based on an anomalous or incorrect measurement due to environmental factors or noise may cause damage or inhibit proper performance of a display. The present invention provides a slowly varying aging correction that will be robust in the presence of noisy measurements and will be imperceptible to a user under a wide variety of environmental circumstances.

A variety of restrictions on changes in correction signal values may be used. For example, the changes may be restricted to monotonically increasing corrections. Since aging in a display increases over time, restricting the changes in correction to a positive value at a variety of rates depending on the usage of the display provides a robust limit on the correction values. This can be important because noisy feedback values from the displays can appear to indicate that the display aging has been reversed. For example, the light output by a display depends on the current passed through the OLED light emitting elements in the display but also depends on the temperature of the OLED elements. If an initial measurement is made at a higher temperature and a subsequent measurement is made at a lower temperature, the efficiency of the display light emitting elements may appear to increase. If a correction value is then reduced to accommodate the apparent increase in display efficiency and the display is then used in a hot environment, the display will not be as bright as intended. This can occur not only by exposure to a variety of external temperatures but by measuring the feedback value at different times during the use of the display. Typically, the display is at room temperature when first turned on. The display then heats up as it is used and the length of time the display is used and the type of content shown on the display markedly affect the temperature of the display and the value of the feedback signals.

Another restriction that may be applied is the magnitude of the change in aging correction parameters. A user may choose to use a display for a long time. If the aging correction cycle is predicated on a usage parameter such as power-up or power-down, significant aging may occur during a single period of use. Because the aging is gradual, it may not be noticeable to the user, particularly because she may have no external comparison reference. However, if a correction to the aging is made all at once, the change may be noticeable, particularly if the change is made during use. By restricting the magnitude of the change to a fixed percentage, for example five percent, the change may be made imperceptible to the user.

Using the present invention, the restriction on corrections can be changed over time. For example, the rate of change in aging of an OLED display tends to decrease over time. Accordingly, the restrictions on the changes in the correction signal can be less during the early portion of the OLED display lifetime and greater during the latter portion of the lifetime of the display. It is also possible to reduce the frequency of corrections as the rate of change in aging of the display decreases during the lifetime of the display.

Another problem that can be encountered when measuring and analyzing the performance of a display is the phenomenon of charge trapping. In normal use, OLED displays may become less efficient due to charge trapping in the organic layers employed to emit light. After some time in an off state, the charges are relinquished and the efficiency of the display improves. If measurements of the display are taken when no charge trapping is present but the device was previously measured and is operated when charges are trapped, an inappropriately optimistic measurement and performance correction will result. Restricting the correction to a monotonically increasing value will inhibit inappropriate corrections of this sort.

Measurements of changes in various display outputs as a whole or for individual light emitting elements or groups of light emitting elements may be made in a variety of ways. For example, the change in current used by the display may be measured, the change in voltage supplied to the display to provide power for a given control signal may be measured, or photosensors may be employed to measure changes in the brightness of the display or individual or groups of pixels. A table of accumulated luminance or current values corresponding to each light emitting element may be employed to track usage of the light emitting elements to estimate changes in brightness of the display. Typical data provided to the display may be sampled to provide estimates of changes in the output of the display. The change in temperature of the display may also be measured to calculate the correction signal.

The groups of light emitting elements to which corrections are applied may include groups of common-color light emitters or light emitters that are spatially distinct, for example contiguous elements in a restricted location. Groups may include light emitting elements at a common brightness level. The corrections applied to the groups may differ. For example, one correction may be applied to light emitting elements emitting light of a particular color at a particular brightness. The restrictions applied in the present invention to the groups may differ. For example, changes in low brightness signals may be less restricted than changes in high brightness signals, or changes in control signals for light emitting elements of one color may be less restricted than changes in control signals for light emitting elements of another color.

The output of the display may be controlled in a variety of ways, depending on the display specifications. For example, the voltage applied to the display may be increased to accommodate an overall reduction in display brightness. Alternatively, the control signals applied to the display representing the desired brightness (typically an analog voltage) may be modified.

A combination of measurements and control mechanisms may also be employed. Moreover, a history of changes may be stored and used to track the changes applied over time. This information may be used to predict future changes or to more intelligently restrict the allowed changes depending on prior display usage patterns. Alternatively, a usage and correction history may be used to modify the restrictions to provide a more robust change correction in the presence of noise.

The corrected control signal may take a variety of forms depending on the OLED display device. For example, if analog voltage levels are used to drive the OLEDs, the correction will modify the voltages of the control signal. This can be done using amplifiers as is known in the art. In a second example, if digital values are used, for example corresponding to a charge deposited at an active-matrix pixel location, a lookup table may be used to convert the digital value to another digital value as is well known in the art. In a typical OLED display device, either digital or video signals are used to drive the display. The actual OLED may be either voltage- or current-driven depending on the circuit used to pass current through the OLED.

The correction signal values used to modify the display control signal such as data signals 34 to form a corrected control signal 36 may be used to correct a wide variety of display performance attributes over time. For example, correction signal values applied to an input data signal may hold the average luminance of the display constant. Alternatively, the correction signal values may be restricted to allow the average luminance of the display to degrade more slowly than it would otherwise due to aging. The display may be held at a constant average luminance output over its lifetime. Alternatively, the luminance may be allowed to decrease in a preferred, controlled fashion over the lifetime of the display.

The present invention can be employed in most top- or bottom-emitting OLED device configurations. These include simple structures comprising a separate anode and cathode per OLED and more complex structures, such as passive matrix displays having orthogonal arrays of anodes and cathodes to form pixels, and active matrix displays where each pixel is controlled independently, for example, with a thin film transistor (TFT). As is well known in the art, OLED devices and light emitting layers include multiple organic layers, including hole and electron transporting and injecting layers, and emissive layers. Such configurations are included within this invention.

In a preferred embodiment, the invention is employed in a device that includes Organic Light Emitting Diodes (OLEDs) which are composed of small molecule or polymeric OLEDs as disclosed in but not limited to U.S. Pat. No. 4,769,292, issued Sep. 6, 1988 to Tang et al. and U.S. Pat. No. 5,061,569, issued Oct. 29, 1991 to VanSlyke et al. Many combinations and variations of organic light emitting displays can be used to fabricate such a device.

The invention has been described in detail with particular reference to certain preferred embodiments thereof, but it will be understood that variations and modifications can be effected within the spirit and scope of the invention.

PARTS LIST

8 initialize correction signal step
10 take measurement step
12 calculate correction step
14 compare correction step
16 decision step
18 restrict correction step
20 apply correction step
30 display
32 controller
34 data signals
36 control signal

38 conversion circuitry
40 feedback signal
42 measurement circuit

What is claimed is:

1. A method for controlling aging compensation in an OLED display having one or more light emitting elements comprising the steps of periodically measuring the change in display output to calculate a correction signal; comparing any change in the periodically calculated correction signal to a correction limit, and restricting the change in the correction signal at each period if the change in the correction signal exceeds the correction limit; and applying the correction signal to the OLED display to effect a correction in the display output.

2. The method claimed in claim 1 wherein the measurement is one or more measurements from the group including a light output of one or more of the light emitting elements; a current used by one or more of the light emitting elements; a voltage across one or more of the light emitting elements; an accumulation over time of the use of current by one or more of the light emitting elements; an accumulation of the luminance values provided to one or more of the light emitting elements; an accumulation of the time that one or more of the light emitting elements is in use; a sampling of the data displayed on the display; and a temperature of the display.

3. The method claimed in claim 1 wherein the correction is restricted to be monotonically increasing.

4. The method claimed in claim 1 wherein the correction is restricted to a fixed percentage change in the correction value.

5. The method claimed in claim 1 wherein the correction is restricted to be monotonically increasing and to a fixed percentage change in the correction value.

6. The method claimed in claim 1 further comprising the step of storing a history of changes in the correction signal and using the history with the measured change to determine the restrictions.

7. The method claimed in claim 1 wherein the restrictions change over time.

8. The method claimed in claim 1 wherein the correction signal is one or more of the group including a voltage applied to the display; a voltage applied to each pixel; a charge applied to each pixel; and a data value applied to each pixel.

9. The method claimed in claim 1 wherein the OLED display is a passive-matrix display.

10. The method claimed in claim 1 wherein the OLED display is an active-matrix display.

11. The method claimed in claim 1 wherein the correction is applied to groups of light emitting elements.

12. The method claimed in claim 1 wherein different corrections and/or restrictions are applied to groups of light emitting elements.

13. The method claimed in claim 12 wherein the groups are colors of light emitting elements.

14. The method claimed in claim 12 wherein the groups are spatially distinct groups of light emitting elements.

15. The method claimed in claim 1 wherein different restrictions and/or corrections are applied to light emitting elements for different display brightness levels.

16. The method claimed in claim 1 wherein the change in display output is measured at power-up of the display.

17. The method claimed in claim 1 wherein the change in display output is measured at power-down of the display.

18. The method claimed in claim 1 wherein the change in display output is measured periodically while the display is in use.

19. The method claimed in claim 18 wherein the period of measuring the change in display output changes over time.

20. The method claimed in claim 1 wherein the correction maintains a constant average luminance output for the display over its lifetime.

21. The method claimed in claim 1 wherein the correction maintains a decreasing level of luminance over the lifetime of the display at a rate slower than that of an uncorrected display.

22. The method claimed in claim 1 wherein the correction is applied with a lookup table.

23. The method claimed in claim 1 wherein the correction is applied with an amplifier.

24. The method claimed in claim 1 wherein the display output is the brightness of the display.

* * * * *